United States Patent [19]

Stewart

[11] 4,105,149

[45] Aug. 8, 1978

[54] TAPE DISPENSING APPARATUS

[76] Inventor: Hal W. Stewart, P.O. Box 1621, Burbank, Calif. 91507

[21] Appl. No.: 728,039

[22] Filed: Sep. 30, 1976

[51] Int. Cl.[2] ..... B26F 3/02

[52] U.S. Cl. ..... 225/25; 225/78

[58] Field of Search ..... 225/78, 66, 47, 25, 225/26; 242/129.7, 136, 55.2

[56] References Cited

U.S. PATENT DOCUMENTS

| | | | |
|---|---|---|---|
| 2,469,247 | 5/1949 | Smith | 225/66 |
| 2,470,250 | 5/1949 | Kieule | 225/78 X |
| 2,581,190 | 1/1952 | Hodges | 225/78 X |
| 2,963,208 | 12/1960 | Yates et al. | 225/78 |
| 3,693,853 | 9/1972 | Siegal | 225/66 X |

*Primary Examiner*—Frank T. Yost

*Attorney, Agent, or Firm*—Lyon & Lyon

[57] ABSTRACT

Disclosed herein is a device for dispensing different types of tape such as masking, duct and electrician's tape which is adapted to be secured to the user's apparel and operated with a single hand. The device is comprised of a body member defining belt loops, a tape roll support and a tape end support. A cutting edge is mounted in the tape end support for severing a desired length of tape from the roll and a locking tab is provided for holding the roll on the tape roll support while allowing the roll to be freely turned thereon.

5 Claims, 2 Drawing Figures

TAPE DISPENSING APPARATUS

BACKGROUND OF THE INVENTION

The present invention relates to a device for dispensing tape such as masking tape, electrician's tape or duct tape etc. which is worn on the user's person and can be operated with a single hand to dispense a desired length of tape for use on a job. When tape is being used on a job such as duct tape by a contractor or masking tape by a painter, it is of utmost importance to always have the roll of tape close at hand and quite often desirable to have a free hand for holding a work piece in place while severing a length of tape from the roll. While tape dispensing devices have been available for years, they do little more than provide an upright stand for the tape and a cutting edge. In addition, such devices are oftentimes bulky; are of little aid in increasing the accessibility of the tape to the user who may be continually moving about; require both hands to dispense a length of tape and employ a single permanent edge which is often-times inadequate when working with tough bonding tapes. Consequently, these devices are of little use to one who uses tape as a standard tool of his profession.

In order for a tape dispensing device to be of significant assistance to a professional as well as one who is merely making home repairs and the like, it should always be accessible such as by being secured to the wearer's person. If so secured, it must be rigidly held and so constructed that it can be operated with a single hand thereby freeing the worker's other hand for holding a work piece in place, retrieving a tool or the like, or holding a brush laden with paint and thereby avoid having to carefully put the brush aside over a drip can or the like, cut and lay a new length of tape and retrieve the brush. In this regard, not only must the dispenser be accessible, but the end of the roll of tape must be so disposed that it can be readily seized by the user and pulled and severed from the roll without requiring total concentration and distraction from the job. Furthermore, the roll of tape must also be securely mounted on the device while allowing free rotation thereof so as not to hamper the single hand dispensing operation and the cutting edge should be replaceable so that an edge could be replaced when it becomes dull, clogged or broken. The tape dispensing device disclosed and claimed herein provides these features.

SUMMARY OF THE INVENTION

Briefly, the present invention is directed to a tape dispensing apparatus which is worn by the user and securely affixed to his apparel so that a length of tape can be pulled therefrom and easily severed from the roll with a single hand. A support surface is provided for the end of the roll of tape which positions said end such that it can be easily retrieved and a replaceable cutting edge is mounted within the support surface to facilitate severance of the length of tape from the roll.

It is the principal object of the present invention to provide a tape dispensing apparatus which is secured to the user's person and can be operated with a single hand to sever a desired length of tape from the roll.

It is another object of the present invention to provide a tape dispensing apparatus which includes replaceable cutting edges.

It is a further object of the present invention to provide an apparatus for dispensing tape which can be operated by a single hand and which is of simple construction and economical to manufacture.

These and other objects and advantages of the present invention will become apparent from the following detailed description taken in conjunction with the accompanying drawings.

IN THE DRAWINGS

Figure 1:
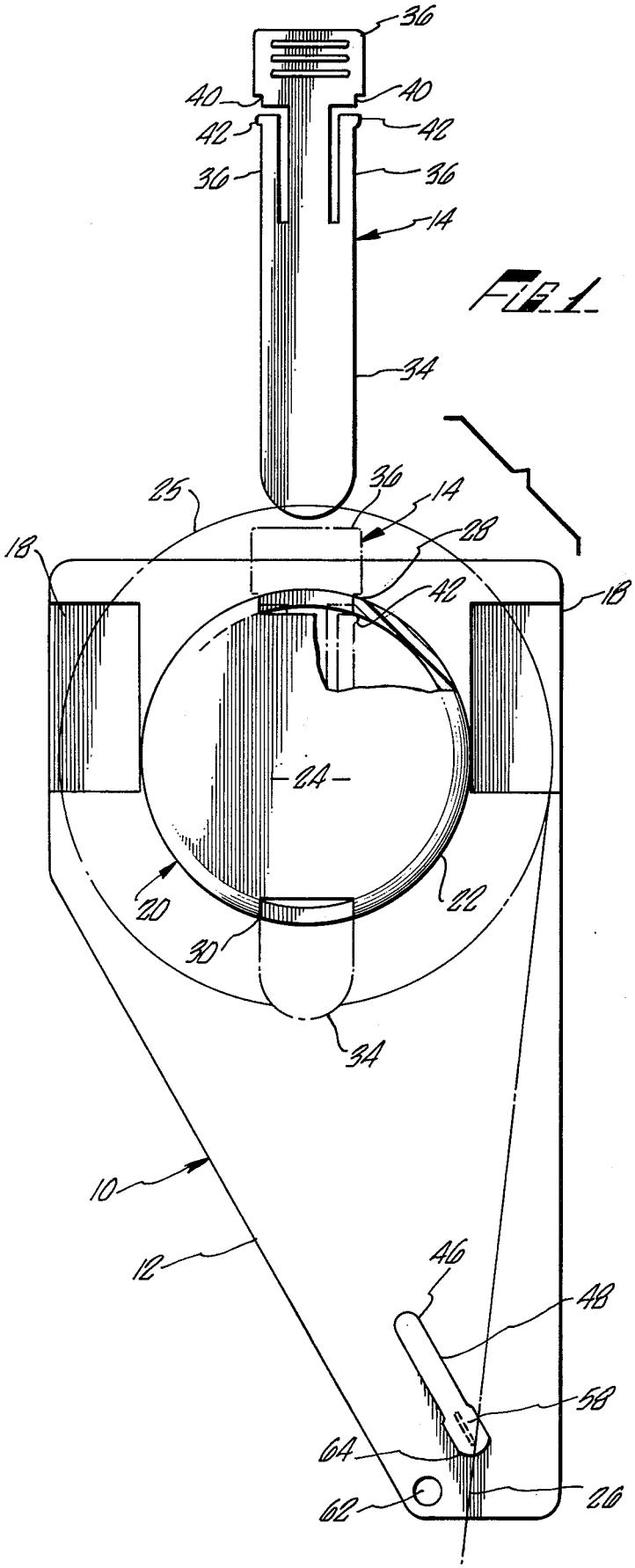
FIG. 1 is a front view of the tape dispensing apparatus showing the locking tab in two positions.
Figure 2:
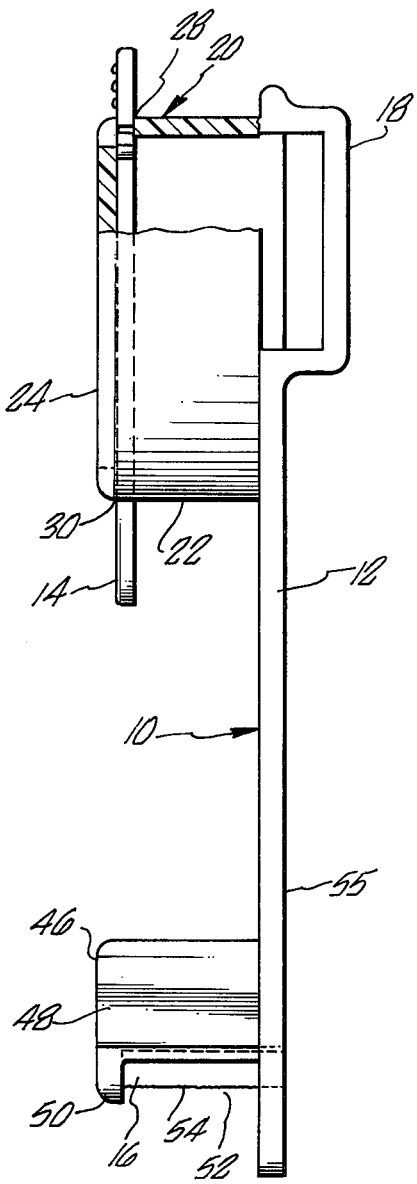
FIG. 2 is a side view of the tape dispensing apparatus.

Referring now in detail to the drawings, the tape dispensing apparatus 10 is comprised of a body member 12, which is preferably constructed of a plastic material in a molding operation so as to be of single piece construction, a tape locking tab 14 and cutting blade 16. The body member 12 defines a pair of belt loops 18 on the backside thereof by which the apparatus can be secured to the wearer's waist and a tape roll support 20 on the front side of the body member. The support 20 is defined by a cylindrical wall 22 protruding from the face of the body member and terminating in a flat, round frontal surface 24 and is adapted to have a roll of tape 25 (shown in phantom lines in FIG. 1) disposed thereover about the cylindrical wall. The outer diameter of support 20 is slightly less than three inches (preferably about 2.97 inches) so that the friction between the interior side of a standard size roll of tape and the cylindrical wall 22 holds the roll in place yet allows rotation of the roll with respect to the cylindrical surface under a force such as that which would be generated by a person pulling on the extended end 26 of the tape.

Tape support 20 has a pair of diametrically opposed apertures 28 and 30 of rectangular configuration cut through cylindrical wall 22 just under the frontal end surface 24 for receiving the locking tab 14. The locking tab is of integral construction and defines an elongated tongue portion 34 which extends through apertures 28 and 30, a head portion 36 by which the tab can be inserted and removed from the roll support and a pair of resilient arms 36. When a roll of tape is positioned on the dispensing apparatus over the cylindrical support 20, the locking tab is inserted through apertures 28 and 30 to the point at which the cylindrical wall abuts stops 40 on the head portion of the tab. In this position, the ends 42 of the resilient arms extend outwardly beyond the ends of the rectangular apertures thereby holding the locking tab in place. Rounded surfaces are provided on the ends of the resilient arms so that the tab can be removed from the roll support by pulling upwardly on the head portion of the tab.

A tape end support 46 is integrally formed on the body member adjacent the lower end thereof. Support 46 defines a rounded tape support surface 48 terminating short of the extended end 50 thereof to define a recessed area 52 to accommodate the cutting edge 54 of a serrated knife blade 16. A channel 58 (see FIG. 1) is angularly disposed within the tape end support 46 and support 20 to receive the blade from the rear side 55 of the support. The blade is held therein by the pressure of the side walls of the channel bearing against the blade. This construction allows the blade to be replaced when it becomes dulled through extensive use and protects against accidental injury by recessing the cutting edge of the blade from the forward end 50 of the support such that the forward end 50 defines a protective side wall for the corner of the cutting blade.

When using the dispensing apparatus 10, the locking tab 14 is pulled from the roll support 20 and a roll of the type of tape to be used is disposed over the roll support. The locking tab is then reinserted through the rectangular apertures in the cylindrical support and held in place by the resilient locking arms 36 thereby securing the roll of tape to the apparatus. The extended end 26 of the roll of tape is then pulled from the roll and laid over the surface 48 of support 46 with any excess being drawn over the cutting edge of the knife and severed therefrom leaving the end of the tape adhering to the surface 48. The apparatus 10 is then secured to the user's person by means of belt loops 18. An aperture 62 is provided in the lowermost end of the apparatus for receiving a tie-down cord (not shown) by which the lower end of the apparatus can be secured to the wearer's leg thereby securely affixing the apparatus to the user's person. In this position, lengths of tape can be pulled and severed from the roll of tape with one hand leaving the new end of the tape roll adhering to the support surface of the tape end support where in can be readily retrieved by the user when needed.

In using the device, it should additionally be noted that the above operational description is particularly suited for light tack tape such as masking tape. With heavy tack tape such as that used for duct and the like, it has been found desirable to draw the tape under the edge of the cutting edge of the blade whereupon the adhesive wall adhere to the underside of the cutting surface of the blade. Accordingly, the tape end support 46 also provides a lower tape support surface 64 for use in drawing the heavier tack tape around the cutting edge of the knife blade.

Various changes and modifications may be made in carrying out the present invention without departing from the spirit and scope thereof. Insofar as these changes and modifications are within the purview of the appended claims, they are to be considered as part of the invention.

I claim:

1. An apparatus adapted to be secured to the apparel of a user for dispensing a length of tape from a tape roll, said apparatus comprising a body member, means carried by said body member for securing said apparatus to the apparel of said user, a walled cylinder protruding from said body member and being adapted to have a roll of tape disposed thereon, said cylinder having a pair of diametrically disposed apertures extending therethrough adjacent the extended end thereof, a locking tab having a tongue portion adapted to extend through said apertures in said cylinder, a head portion extending from one end of said tongue portion and at least one resilient arm portion integrally formed with said tongue portion and extending substantially parallel thereto such that upon disposing said tongue portion through said aperture and over a tape roll, the portion of said walled cylinder adjacent one of said apertures is held between the head portion of said locking tab and the extended end of said resilient locking arm, means carried by said body member for supporting the extended end of said tape roll, said means having a walled channel therein, and cutting means disposed within said walled channel for severing a length of tape from said tape roll.

2. An apparatus adapted to be secured to the apparel of a user for dispensing a length of tape from a tape roll, said apparatus comprising a body portion of integral construction and defining means for securing said apparatus to the apparel of said user, a cylindrical tape roll support and a tape end support, said cylindrical tape roll support having a pair of diametrically disposed apertures extending therethrough adjacent the extended end thereof, said tape end support being spaced along said body portion from said tape roll support and defining a tape end support surface and having a walled channel disposed therein, a locking tab having a tongue portion adapted to extend through said apertures in said roll support, a head portion extending from one end of said tongue portion and at least one resilient arm integrally formed with said tongue portion and extending substantially parallel thereto such that upon disposing said locking tab through said apertures and over a tape roll disposed on said cylindrical tape roll support, the portion of said cylindrical roll support adjacent one of said apertures is held between said head portion of said locking tab and the extended end of said resilient locking arm, and cutting means disposed within said walled channel of said tape end support for severing a length of tape from said tape roll.

3. The combination of claim 2 wherein said tape end support includes a second support surface, said support surface being disposed on the opposite side of said support from said first surface for exposing the upper surface of said tape to said cutting means for use with heavy tack tape.

4. The combination of claim 2 wherein said apparel securing means is comprised of a pair of belt loops integrally formed with said body member and extending from the opposite side thereof as said cylindrical tape roll support.

5. An apparatus adapted to be secured to the apparel of the user for dispensing a length of tape from a tape roll, said apparatus comprising a body of single piece integral construction defining means for securing said apparatus to the apparel of said user, a cylindrical tape roll support and a tape end support, said cylindrical tape roll support having a pair of diametrically disposed apertures extending therethrough adjacent the extended end thereof, said tape end support being spaced along said body from said tape roll support, having a walled channel disposed therein and defining integrally therewith a tape end support surface and protective side wall, a locking tab having a tongue portion adapted to extend through said apertures in said roll support and over a tape roll, and cutting means disposed within said walled channel fo said tape end support interiorly of said protective side wall for severing a length of tape from said tape roll.

* * * * *